US009004933B2

(12) United States Patent
Birkin

(10) Patent No.: US 9,004,933 B2
(45) Date of Patent: Apr. 14, 2015

(54) DETONATOR ASSEMBLY

(75) Inventor: Christopher Malcolm Birkin, Centurion (ZA)

(73) Assignee: Detnet South Africa (Pty) Ltd (ZA)

( * ) Notice: Subject to any disclaimer, the term of this patent is extended or adjusted under 35 U.S.C. 154(b) by 154 days.

(21) Appl. No.: 13/883,412

(22) PCT Filed: Nov. 15, 2011

(86) PCT No.: PCT/ZA2011/000086
§ 371 (c)(1),
(2), (4) Date: May 3, 2013

(87) PCT Pub. No.: WO2012/068592
PCT Pub. Date: May 24, 2012

(65) Prior Publication Data

US 2013/0231000 A1 Sep. 5, 2013

(30) Foreign Application Priority Data

Nov. 16, 2010 (ZA) ..... 2010/08183

(51) Int. Cl.
*H01R 13/62* (2006.01)
*H01R 13/193* (2006.01)
(Continued)

(52) U.S. Cl.
CPC ..... *H01R 13/193* (2013.01); *F42B 3/103* (2013.01); *F42C 11/06* (2013.01); *F42C 19/02* (2013.01);
(Continued)

(58) Field of Classification Search
CPC ..... H01R 12/79; H01R 13/5208; H01R 13/5219; H01R 13/62933; H01R 13/6658; F42B 3/13; F42B 3/103; F42B 39/30; F42D 1/05; F42D 1/04; F42D 1/042; F42D 1/043; F42D 1/055
USPC ..... 439/76.1, 271, 310, 311, 495, 587; 102/202.5, 202.9, 202.11, 202.12, 102/202.14, 206, 217, 275.2–275.8, 275.12
See application file for complete search history.

(56) References Cited

U.S. PATENT DOCUMENTS 2,972,125 A 2/1961 Temple et al.
4,211,459 A 7/1980 Madden
(Continued)

FOREIGN PATENT DOCUMENTS

CN 2113336 U 8/1992
EP 0540260 A2 5/1993
(Continued)

OTHER PUBLICATIONS

International Preliminary Report on Patentability for PCT/ZA2011/000086, international filing date of Nov. 15, 2011, mailed Jan. 31, 2013, 9 pages.
(Continued)

*Primary Examiner* — Thanh Tam Le
(74) *Attorney, Agent, or Firm* — Cantor Colburn LLP

(57) ABSTRACT

A detonator (14) has a printed circuit board (18) with conductive contact pads (26) which are electrically connected to conductors (32, 34) by means of a compression-type fitting. The compression-type fitting includes a cover (40), a seal (46) and a locking member (54) through which the electrical conductors in the form of a cable (12) are slidably threaded in the stated order. The detonator (14) has at its trailing end (24) a wedge-shaped part (28) having a serrated surface (28A). Locking member (54) has a tapered cavity (56) having a serrated surface (56A). Cover (40) is slid along cable (12) to force locking member (54) into locking engagement with wedge-shaped part (28) to hold conductors (32, 34) in contact with contact pads (26).

3 Claims, 2 Drawing Sheets

(51) Int. Cl.

| | |
|---|---|
| ***F42B 3/103*** | (2006.01) |
| ***F42C 11/06*** | (2006.01) |
| ***F42C 19/02*** | (2006.01) |
| ***F42D 1/04*** | (2006.01) |
| ***F42D 1/045*** | (2006.01) |
| ***H01R 12/62*** | (2011.01) |
| ***H01R 12/85*** | (2011.01) |
| *H01R 13/52* | (2006.01) |
| *H01R 13/66* | (2006.01) |

(52) U.S. Cl.

CPC ..... *F42D 1/043* (2013.01); *F42D 1/045* (2013.01); *H01R 12/62* (2013.01); *H01R 12/85* (2013.01); *H01R 13/5205* (2013.01); *H01R 13/6658* (2013.01)

(56) References Cited

U.S. PATENT DOCUMENTS

| | | | | | |
|---|---|---|---|---|---|
| 5,259,782 | A | * | 11/1993 | Giffin | 439/367 |
| 5,327,835 | A | * | 7/1994 | Adams et al. | 102/275.11 |
| 5,417,162 | A | * | 5/1995 | Adams et al. | 102/317 |
| 5,470,248 | A | * | 11/1995 | Wood | 439/281 |
| 5,567,174 | A | | 10/1996 | Ericson, Jr. et al. | |
| 6,082,264 | A | * | 7/2000 | Meyer et al. | 102/202.9 |
| 6,374,740 | B1 | * | 4/2002 | Moulard | 102/275.3 |
| 6,655,289 | B1 | * | 12/2003 | Bornheim et al. | 102/202.12 |
| 6,974,341 | B2 | * | 12/2005 | Jennings | 439/191 |
| 7,828,570 | B2 | | 11/2010 | Suzuki et al. | |
| 7,987,787 | B1 | * | 8/2011 | Sudick | 102/202.1 |
| 8,069,789 | B2 | | 12/2011 | Hummel et al. | |
| 8,702,439 | B1 | * | 4/2014 | Paulsel et al. | 439/271 |
| 8,863,665 | B2 | * | 10/2014 | DeVries et al. | 102/206 |
| 2007/0207669 | A1 | | 9/2007 | Hummel et al. | |
| 2009/0130881 | A1 | | 5/2009 | Suzuki et al. | |

FOREIGN PATENT DOCUMENTS

| | | | |
|---|---|---|---|
| WO | 9310577 | A1 | 5/1993 |
| WO | 2006077092 | A1 | 7/2006 |

OTHER PUBLICATIONS

International Search Report for PCT/ZA2011/000086, international filing date of Nov. 15, 2011, mailed Feb. 22, 2012, 5 pages.

Written Opinion for PCT/ZA2011/000086, international filing date of Nov. 15, 2011, mailed Jun. 16, 2012, 7 pages.

* cited by examiner

DETONATOR ASSEMBLY

CROSS-REFERENCE TO RELATED APPLICATIONS

This application is a U.S. national stage application of International Application No. PCT/ZA2011/000086 entitled "CONNECTOR ASSEMBLY", which has an international filing date of 15 Nov. 2011, and which claims priority to South African Patent Application No. 2010/08183, filed 16 Nov. 2010.

BACKGROUND OF THE INVENTION

This invention relates generally to a detonator which comprises a connector assembly.

The invention is more particularly concerned with an arrangement which facilitates the making of an electrical connection of a detonator to one or more conductors.

SUMMARY OF THE INVENTION

The invention generally provides a detonator which comprises a connector assembly which includes a cable which has at least one electrical conductor which extends from electrical insulating material, and a connection arrangement which includes a first part, a second part which is displaceable towards the first part, a contact pad between the parts, against which the electrical conductor is located, and a locking member which is movable to an operative position thereby to urge the parts towards each other and to retain the conductor in electrical contact with the contact pad and engaged between the parts.

More specifically, the invention provides a detonator which comprises a housing, a printed circuit board which is, at least partly, inside the housing, and which has conductive contact pads, and an insulated cable with electrical conductors. The detonator is characterised in that: a) the housing has a wedge-shaped part with an inclined face and a surface, and cavities formed in the surface, which cavities oppose respective conductive contact pads; b) the detonator further comprises a locking member with a tapered cavity and a base, and a passage in the base; c) the cable extends through the passage, the exposed leading ends of the conductors are respectively positioned in the cavities, and the wedge-shaped part is located at least partly inside the cavity; and in that d) the locking member is movable to an operative position thereby to urge the wedge-shaped part and the printed circuit board towards each other whereby the exposed ends of the conductors are clamped by the surface in electrical contact with respective ones of the contact pads.

Another aspect of the invention provides that the detonator is characterised in that it includes a seal which is engaged with the cable and which bears against the locking member, and a cover which is slidably engaged with the cable and which is movable to enclose the seal and at least part of the locking member.

Yet another aspect of the invention provides that the detonator is characterised in that the cover is movable to urge the seal into close contact with the locking member and an outer surface of the cable.

Other aspects of the invention provide one or more of the following features, alone or in any suitable combination.

The contact pad may be located at a formation between the parts. The formation may be a cavity or recess in at least one of the parts.

The connection arrangement may be on or in a housing and may be at one end of a housing which, in turn, may be elongate.

The contact pad may be unsupported and, for example, may project from a suitable support structure i.e. the contact pad may be in the nature of a pin or projection. Alternatively the contact pad may be backed by support structure. The contact pad may be provided on a printed circuit board ("PCB") at least part of which may be positioned inside a housing. At least a portion of the PCB may be one of the parts referred to. Preferably the portion of the PCB is the first part. The contact pad may be shaped, e.g. with a recess, to help position the electrical conductor in contact with the pad.

The locking member may have a shape which is complementary to at least a portion of at least one of the first and second parts. The locking member may be shaped so that a clamping action is exerted on the electrical conductor upon movement of the locking member to the operative position.

The clamping action may be achieved in any appropriate way and for example may be achieved by means of a wedging or inclined plane action. For example a sloping surface of one part may be inclined to a direction in which the locking member is moved, toward the operative position, and the locking member may have an actuating surface which is inclined to said direction and which bears against the sloping surface.

A seal may be engaged with the cable and bear against the locking member. The seal may be compressed or otherwise deformed by the locking member. This enhances the sealing effect of the seal. Additionally the seal then acts to form a strong physical bond between the housing and the cable. This helps to prevent the cable from inadvertently being pulled free from the housing—an action which could break the electrical connection between the conductor and the pad.

A cover, which is slidably engaged with the cable, may be movable to enclose, and thereby protect, at least a portion of the connection arrangement. Additionally the cover may act to help retain the locking member in the operative position.

The connector assembly may be used with any appropriate electrical arrangement. In one form of the invention the connector assembly can be used, with substantial benefit, for making an electrical connection to a circuit in a detonator. In this instance, which is intended to fall inside the scope of the application, the detonator may include a housing and the connection arrangement may be mounted to or form part of the housing.

The PCB referred to may be located inside the housing and carry a circuit which is used to control firing of the detonator.

BRIEF DESCRIPTION OF THE DRAWINGS

The invention is further described by way of example with reference to the accompanying drawings in which.

DESCRIPTION OF PREFERRED EMBODIMENTS

Figure 1:
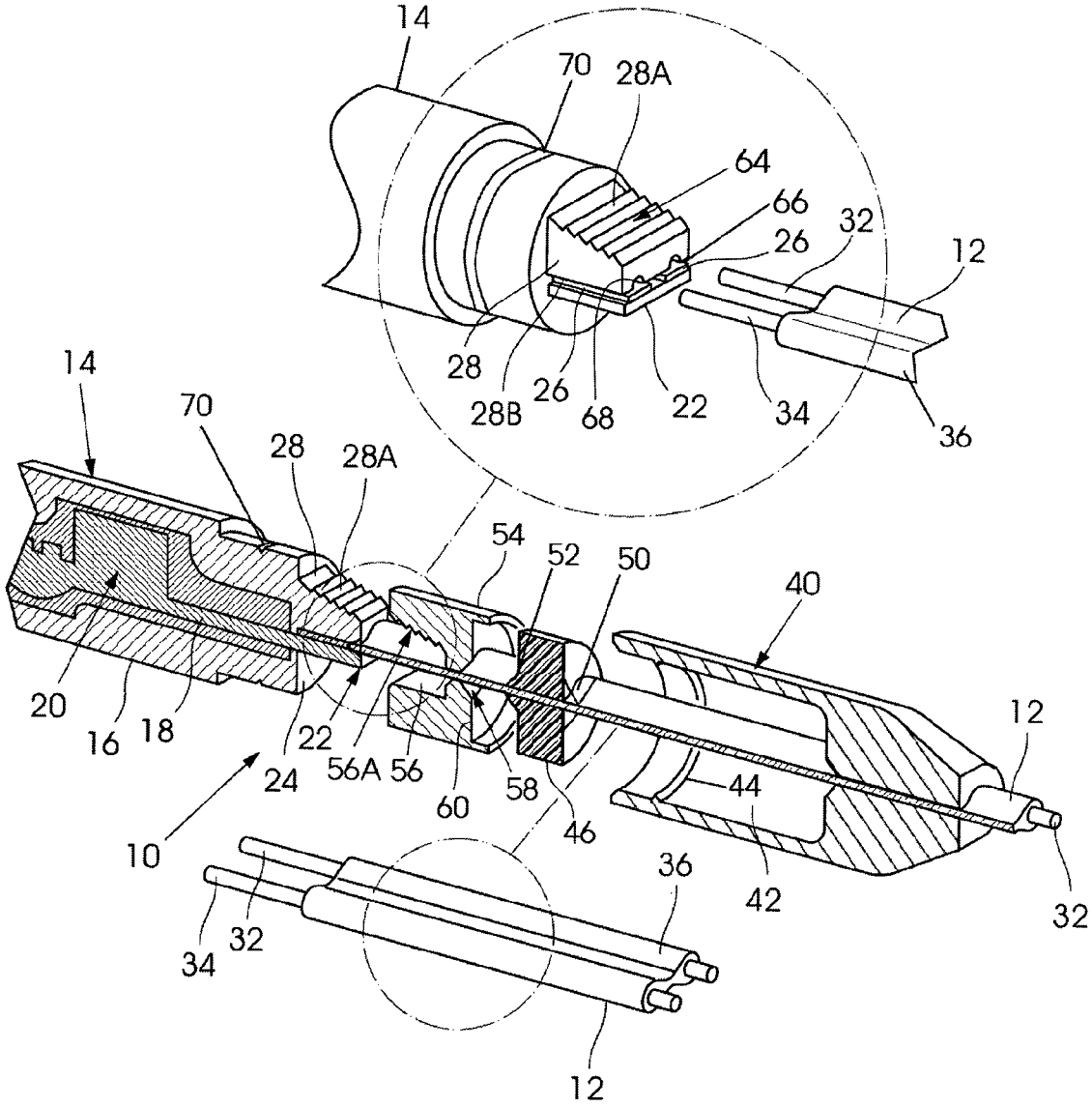
FIG. 1 is a side view in cross-section, partly in perspective, of a detonator which includes a connector assembly according to the invention.

FIG. 1 of the accompanying drawings illustrates, in cross-section and in an exploded configuration, a connector assembly 10 according to the invention, a cable 12 and a detonator 14 to which the connector assembly is mounted.

The detonator has a housing 16 in which is located a PCB 18. An electrical circuit and a plurality of electrical components, collectively designated with the reference 20, are mounted to the PCB. The circuit and components may be of any suitable kind known in the art. This aspect is not important to an understanding of the invention and, for this reason, the circuit and the components are not further described herein.

The PCB has an end section 22 which extends from a trailing end 24 of the housing. Conductive contact pads 26 on the end section oppose a wedge-shaped part 28 at the trailing end 24. The contact pads are, typically, formed from metal strips which, for example, are deposited on a substrate of the PCB. Alternatively the pads may be mounted to any other suitable support structure. It is also possible for the pads to be fairly rigid and robust and to project, e.g. as small pins, from a support such as a PCB.

The pads are electrically connected to the circuit and components 20 in a manner which is known in the art.

The cable 12, also shown in the inset drawing to FIG. 1, has two elongate electrical conductors 32 and 34 respectively, encased in insulation material 36. The insulation material is stripped to expose leading ends of the conductors. A cover 40, made from a suitable protective and insulating material, is slidably positioned on the cable. The cover is formed with a cavity 42. A small rib 44 is on an inner surface of the cavity. This rib, in cross-section, is tooth-shaped.

A seal 46, made from a resiliently deformable material, is slidably located on the cable. The seal is designed to be located with a tight and sliding fit, inside the cavity. Portions 50 and 52 on opposing surfaces of the seal, immediately adjacent the entry and exit points of the cable, project outwardly. These portions are designed to engage with a tight sealing fit with complementary recesses in the cover and in a locking member 54 which is positioned between the seal and the housing.

The locking member has an external cylindrical shape and a tapered cavity 56, of complementary shape to the wedge part 28. The cable 12 passes through a passage 58 in a base 60 of the cavity. Opposed inclined faces 28A and 56A of the wedge part and the cavity respectively are formed with a plurality of interlockable serrations 64.

The wedge part 28 has a substantially flat surface 28B which opposes the contact pads 26 on the end section 22 of the PCB. Two cavities in the form of shallow elongate slots 66 and 68 respectively are formed in the surface 28B—see the insert drawing to FIG. 1.

In order to make a sound electrical connection between the cable and the circuit and components 20, the cable is passed through the cover, the seal and the locking member, in that sequence. The exposed conductors 32 and 34 are then slid into the slots 66 and 68 of the wedge part 28. Thereafter the locking member is moved along the cable, towards the housing. The surface 56A rides over the surface 28A. This occurs with an inclined plane action for in the process the surface 56A acts as an actuating surface which urges the wedge part towards the contact pad 26. The conductors 32 and 34 are thus tightly clamped between these components. The serrations 64 on the two components 28 and 56 interengage with one another and ensure that the locking member is firmly held in an operative position at which the conductors are electrically connected to the parts. The seal is then pushed against a trailing side of the locking member and the cover 40 is moved over the seal compressing it firmly against an adjacent surface of the locking member. The compressed seal is distorted and is forced into close contact with a wall of the cavity 42 and with an outer surface of the cable 12. The sealing action of the seal is thereby enhanced. Additionally the seal is tightly frictionally engaged with an outer surface of the cable and this serves to establish a physical bond between the cable and the cover 40 and the housing 16. If a tensile force is exerted on the cable it is therefore less likely to pull free from the connection arrangement i.e. the conductors 32 and 34 are held more securely in electrical contact with the pads.

Figure 2:
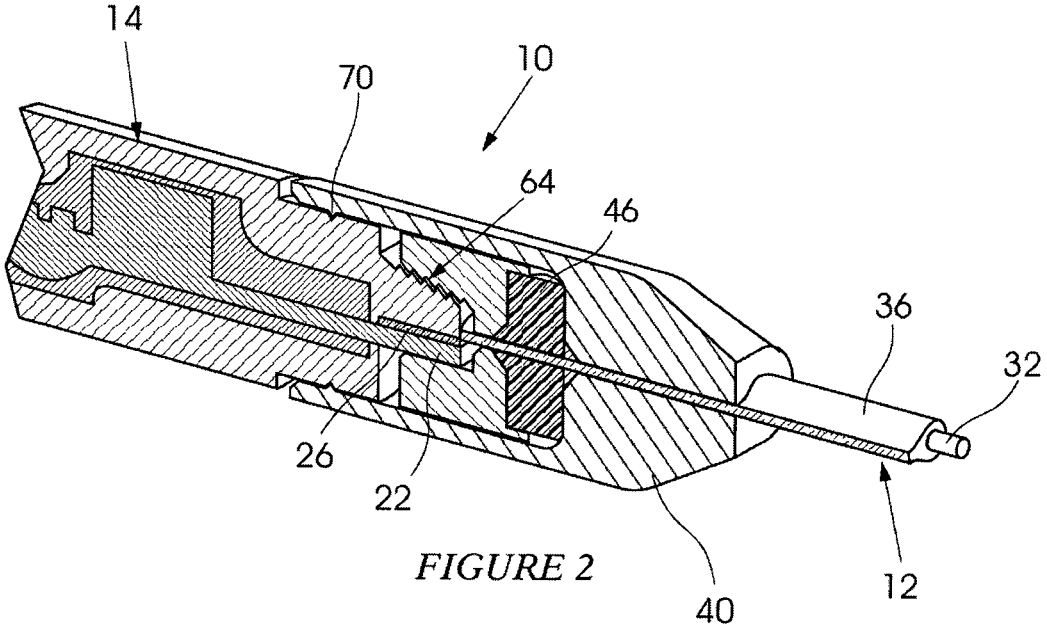
FIG. 2 is similar to FIG. 1 but showing the detonator with the connector assembly in an operative mode.

The cover is secured to the housing by means of the rib 44 which engages with a clip action with a corresponding slot 70 in an outer surface of the housing. Alternatively or additionally the cover may be fixed to the housing by using an adhesive or by making use of a bonding, ultrasonic welding, or any suitable or equivalent process. The cable is thereby electrically and physically secured to the connector assembly 10 and hence to the detonator 14, as is shown in FIG. 2.

In the preceding example the printed circuit board carries components which are used to control operation of a detonator. It is apparent that electrical components on the printed circuit board could be used for other purposes and, at least for this reason, the principles of the invention are not restricted to the making of an electrical connection to electrical components in a detonator.

In the example the slots 66 and 68 help to position the conductors in contact with the pads 26. Alternatively, or additionally, each contact pad could be recessed, thereby to help positioning the conductors correctly.

The invention claimed is:

1. A detonator comprising a housing, a printed circuit board disposed at least partly inside the housing, the circuit board having conductive contact pads, and an insulated cable having an outer surface and comprising electrical conductors having respective exposed leading ends, characterised in that:

a) the housing has a wedge-shaped part with an inclined face and a surface, and cavities formed in the surface, the cavities opposing respective ones of the conductive contact pads, b) the detonator further comprises a locking member with a tapered cavity and a base, and a passage in the base, c) the cable extends through the passage, the exposed leading ends of the conductors are respectively positioned in the cavities, and the wedge-shaped part is located at least partly inside the tapered cavity, and in that d) the locking member is movable to an operative position thereby to urge the wedge-shaped part and the printed circuit board towards each other whereby the exposed ends of the conductors are clamped by the surface in electrical contact with respective ones of the contact pads.

2. A detonator according to claim 1 characterised in that the detonator includes a seal which is engaged with the cable and bears against the locking member, and a cover slidably engaged with the cable, the cover being movable to enclose the seal and at least part of the locking member.

3. A detonator according to claim 2 characterised in that the cover is movable to urge the seal into close contact with the locking member and the outer surface of the cable.

* * * * *